US010035242B2

(12) United States Patent
Yamamoto et al.

(10) Patent No.: US 10,035,242 B2
(45) Date of Patent: Jul. 31, 2018

(54) SHOT-BLASTING APPARATUS

(71) Applicant: SINTOKOGIO, LTD., Nagoya-shi, Aichi (JP)

(72) Inventors: Shoichi Yamamoto, Toyokawa (JP); Takuya Koyama, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 111 days.

(21) Appl. No.: 15/033,027

(22) PCT Filed: Oct. 19, 2015

(86) PCT No.: PCT/JP2015/079424

§ 371 (c)(1),
(2) Date: Apr. 28, 2016

(87) PCT Pub. No.: WO2016/199321

PCT Pub. Date: Dec. 15, 2016

(65) Prior Publication Data

US 2017/0190022 A1 Jul. 6, 2017

(30) Foreign Application Priority Data

Jun. 11, 2015 (JP) ..... 2015-118279

(51) Int. Cl.
*B24C 9/00* (2006.01)
*B24C 3/20* (2006.01)
*B24C 3/24* (2006.01)

(52) U.S. Cl.
CPC ..... *B24C 9/003* (2013.01); *B24C 3/20* (2013.01); *B24C 3/24* (2013.01); *B24C 9/00* (2013.01)

(58) Field of Classification Search
CPC .... B24C 3/20; B24C 3/24; B24C 9/00; B24C 9/003

(Continued)

(56) References Cited

U.S. PATENT DOCUMENTS 3,300,902 A * 1/1967 Dockery ..... B24C 9/006 209/137
3,742,650 A * 7/1973 Graf ..... B24C 9/006 451/101

(Continued)

FOREIGN PATENT DOCUMENTS

JP 53-25986 A 3/1978
JP 2005-329482 A 12/2005
JP 2011-224726 A 11/2011

*Primary Examiner* — Eileen Morgan
(74) *Attorney, Agent, or Firm* — Brinks Gilson & Lione

(57) ABSTRACT

Provided is a shot-blasting apparatus which is capable of efficiently perform dust collection and ventilation of an inside of a projection chamber, even using a dust collector having a small-size and low-cost suction device. The shot-blasting apparatus comprises: a cabinet (10); a plurality of process chambers (13*a*, 13*b*) provided inside the cabinet in such a manner that each of the process chambers is capable of housing a workpiece therein and selectively movable between a carry-in-and-out position and a projection position; an air inlet port (19) for introducing external air into each of the process chambers therethrough; and an air outlet port provided at a position opposed to the air inlet port across the process chamber set at the projection position, and linearly communicated with an internal space of the process chamber set at the projection position, wherein, according to suction from the air outlet port, air is caused to flow from the air inlet port into the process chamber set at the projection position, and led to the air outlet port while passing through the process chamber set at the projection position.

3 Claims, 8 Drawing Sheets

(58) Field of Classification Search
USPC ..... 451/38, 84, 89
See application file for complete search history.

(56) References Cited

U.S. PATENT DOCUMENTS

| | | | | | |
|---|---|---|---|---|---|
| 4,326,362 | A * | 4/1982 | Williams | B24C 3/00 | 451/80 |
| 5,177,911 | A * | 1/1993 | Ruemelin | B24C 9/00 | 451/456 |
| 5,556,324 | A * | 9/1996 | Shank, Jr. | B24C 9/00 | 451/87 |
| 7,249,994 | B2 * | 7/2007 | Sommacal | B24C 1/003 | 451/88 |
| 7,832,243 | B2 * | 11/2010 | Ushida | B24C 9/006 | 29/90.7 |
| 9,039,487 | B2 * | 5/2015 | Mase | B24C 1/04 | 451/38 |
| 2008/0066512 | A1 * | 3/2008 | Ushida | B24C 9/006 | 72/53 |

* cited by examiner

B — B

SHOT-BLASTING APPARATUS

This application is a 371 application of PCT/JP2015/079424 having an international filing date of Oct. 19, 2015, which claims priority to JP2015-118279 filed Jun. 11, 2015. The entire contents of these applications are incorporated herein by reference.

TECHNICAL FIELD

The present invention relates to a shot-blasting apparatus, and more specifically to a shot-blasting apparatus configured to project shots onto a workpiece.

BACKGROUND ART

There has been known a shot-blasting apparatus configured to project shots onto a workpiece disposed in a projection chamber to process a workpiece (see the following Patent Document 1). In the shot-blasting apparatus, due to collision of shots against the workpiece in the projection chamber, a large amount of powder dust is inevitably generated in the projection chamber. Therefore, such powder dust generated in the projection chamber is collected by a dust collector to thereby keep a working environment around the apparatus clean.

As an example of the shot-blasting apparatus, a type shown in FIGS. 1 and 2 is commonly known. This type of shot-blasting apparatus comprises a cabinet 1, and a rotary hanger 2 installed inside the cabinet 1. The rotary hanger 2 is equipped with a hanger hook for suspendingly supporting a workpieces.

The rotary hanger 2 is a member which has a drum shape (cylindrical shape) and comprises two process chambers 3*a*, 3*b* arranged at radially opposed positions, wherein the hanger hook is configured to suspend a workpiece in each of the process chambers. The rotary hanger 2 is configured to be rotatable intermittently about a longitudinal axis extending in a vertical direction, as indicated by the arrowed lines R1.

According to this rotation, each of the process chambers 3*a*, 3*b* is selectively moved between a carry-in-and-out position on the side of a front end of the apparatus and a projection position on the side of a back end of the apparatus. Each of the process chambers serves as a carry-in-and-out chamber 3*a* for carrying in and out the workpiece at the carry-in-and-out position and as a projection chamber 3*b* for projecting shots to the workpiece at the projection position.

In this type of shot-blasting apparatus, after placing a new workpiece on the hanger hook in the carry-in-and-out chamber 3*a*, the rotary hanger 2 is rotated 180 degrees to allow the carry-in-and-out chamber 3*a* having the workpiece disposed therein to be located on the side of the back end of the apparatus so as to serve as the projection chamber 3*b*. Then, a projector is activated to project shots onto the workpiece suspended in the projection chamber 3*b*.

In this type of shot-blasting apparatus, a cabinet suction port 4 is provided in a back-end region of the cabinet 1 at a position on the side of one lateral edge of a top wall of the cabinet 1, to introduce external air into the cabinet 1 through the cabinet suction port 4. Further, a separator suction port 6 is provided in a separator 5 disposed at a widthwise center of the back-end region of the cabinet 1, to suck external air therethrough. The external air introduced from the cabinet suction port 4 and the separator suction port 6 flows into a dust collector (not shown) via ducts 7, 8.

The above conventional shot-blasting apparatus is thus configured to remove powder dust from air in the projection chamber 3*b* by the dust collector having a suction device.

CITATION LIST

Patent Document

Patent Document 1: JP 2005-329482A

SUMMARY OF THE INVENTION

Technical Problem

As mentioned above, in the above shot-blasting apparatus, both of the cabinet suction port 4 as an external air supply port to the cabinet, and the separator suction port 6, are provided in the back-end region of the cabinet. Thus, external air introduced from the cabinet suction port 4 located in the back-end region of the cabinet, into the cabinet, and external air sucked from the separator suction port 6 located in the back-end region of the cabinet, are caused to flow through the back-end region of the cabinet (i.e., through a region located backward of the projection chamber), and led outside the cabinet (shot-blasting apparatus) via the ducts 7, 8, without passing through the projection chamber, as indicated by the arrowed lines in FIG. 1.

Thus, a flow path of external air introduced into the cabinet is not formed to pass through the projection chamber 3 as a powder dust source, thereby leading to a problem of failing to effectively remove powder dust in the projection chamber 3*b*.

Moreover, the two suction ports are provided at different positions, so that the suction device for sucking air into the dust collector requires a large suction force, thereby leading to a problem that the suction device for sucking air into the dust collector sizes up, and an operation cost and a device cost become higher.

The present invention has been made in view of the above problems, and an object thereof is to provide a shot-blasting apparatus capable of efficiently perform dust collection and ventilation of an inside of a projection chamber, even using a dust collector having a small-size and low-cost suction device.

Solution to Technical Problem

The present invention provides a shot-blasting apparatus which comprises: a cabinet; a plurality of process chambers provided inside the cabinet in such a manner that each of the process chambers is capable of housing a workpiece therein and selectively movable between a carry-in-and-out position on the side of a front end of the apparatus and a projection position on the side of a back end of the apparatus; an air inlet port for introducing external air into each of the process chambers therethrough; and an air outlet port provided at a position opposed to the air inlet port across the process chamber set at the projection position, and linearly communicated with an internal space of the process chamber set at the projection position, wherein, according to suction from the air outlet port, air is caused to flow from the air inlet port into the process chamber set at the projection position, and led to the air outlet port while passing through the process chamber set at the projection position.

In the shot-blasting apparatus having this feature, external air inflowing from the air inlet port flows into the air outlet port while reliably passing through the projection chamber, so that it becomes possible to enhance ventilation efficiency of an inside of the projection chamber.

In one preferred embodiment of the present invention, the air outlet port is provided at a position opposed to the air inlet port across a central region of the process chamber set at the projection position.

In the shot-blasting apparatus having this feature, external air inflowing from the air inlet port flows into the air outlet port while reliably passing through the projection chamber, so that it becomes possible to further enhance the ventilation efficiency of the inside of the projection chamber.

In another preferred embodiment of the present invention, the shot-blasting apparatus comprises an approximately cylindrical-shaped rotary hanger having a top plate, a bottom plate, and a partition plate connecting the top plate and the bottom plate together to form the process chambers, wherein the rotary hanger is rotatably disposed within the cabinet, and wherein the chambers are spaced apart from each other in a circumferential direction of the rotary hanger.

More preferably, in the above preferred embodiment, the process chambers are provided at intervals of a given angle.

More preferably, the shot-blasting apparatus according to the above preferred embodiment comprises an external air introduction chamber provided adjacent to each of the process chambers, wherein the external air introduction chamber is partitioned with respect to the process chambers by the partition plate, and has an external air introduction port communicated with the air inlet port and the air outlet port.

More preferably, in the above preferred embodiment, the air inlet port is provided in the partition wall.

More preferably, in the above preferred embodiment, the external air introduction chamber is divided into two small chambers by a division plate disposed to extend in a vertical direction and provided with a vent hole.

More preferably, in the above preferred embodiment, the air inlet port is covered by a hood attached to the partition plate from the side of the external air introduction chamber.

The shot-blasting apparatus according to yet another preferred embodiment of the present invention further comprises a dust collector communicated with the air outlet port.

In still another preferred embodiment of the present invention, the air outlet port is formed in a bucket elevator disposed in a back-end region of the cabinet.

In the shot-blasting apparatus having this feature, it becomes possible to reduce the number of ducts required for air releasing to downsize the entire apparatus.

Effect of Invention

The present invention can provide a shot-blasting apparatus capable of efficiently perform dust collection and ventilation of an inside of a projection chamber, even using a dust collector having a small-size and low-cost suction device.

DETAILED DESCRIPTION OF THE PREFERRED EMBODIMENTS

With reference to the drawings, a shot-blasting apparatus according to a preferred embodiment of the present invention will now be described.

Figure 1:
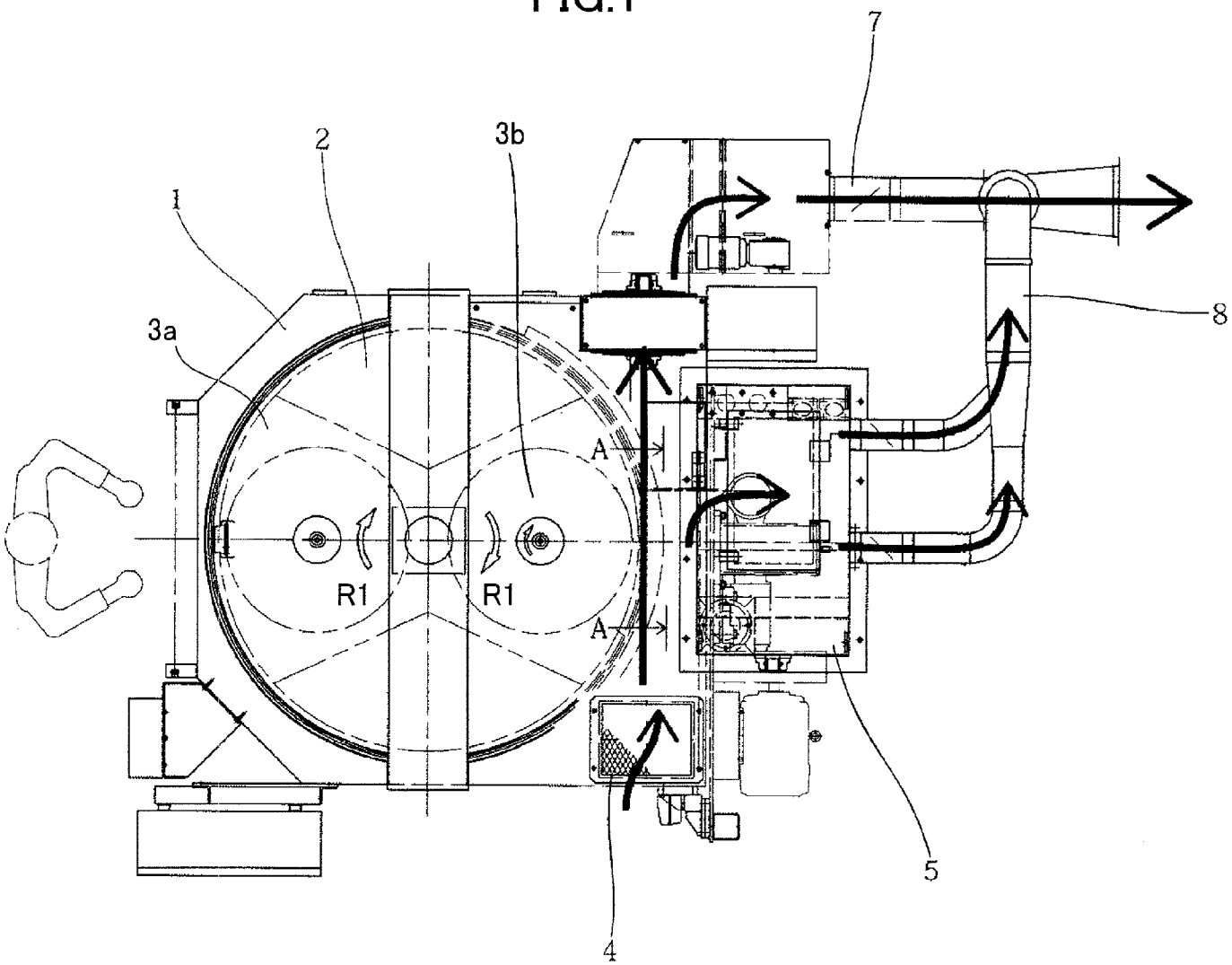
FIG. 1 is a horizontal sectional view showing a conventional shot-blasting apparatus.
Figure 2:
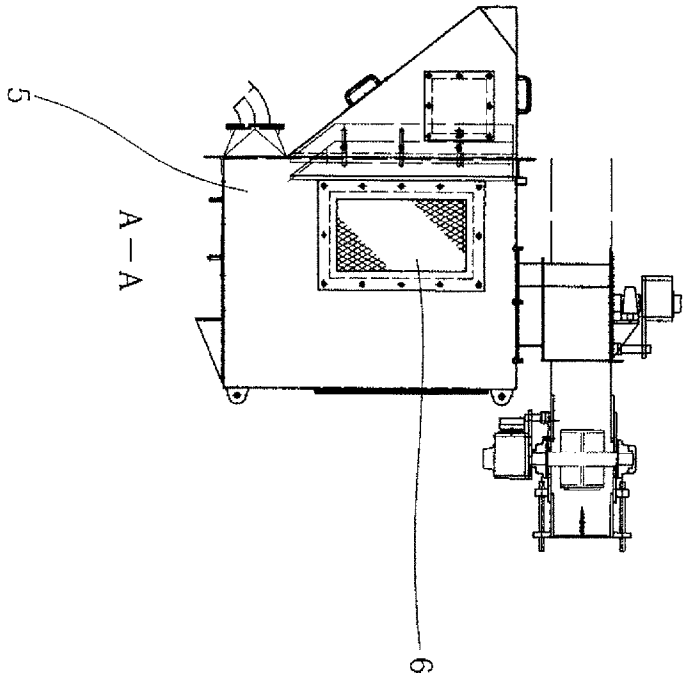
FIG. 2 is a sectional view taken along the line A-A in FIG. 1.
Figure 3:
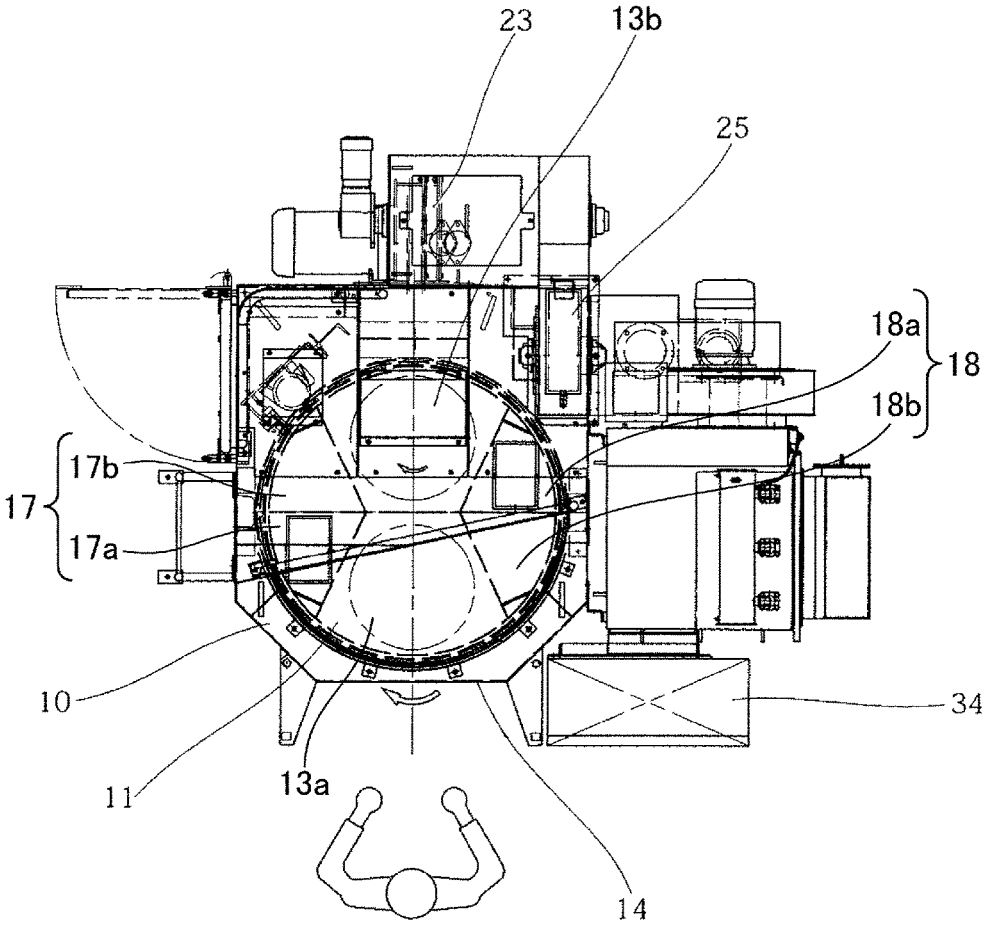
FIG. 3 is a horizontal sectional view showing a shot-blasting apparatus according to one embodiment of the present invention.

FIG. 3 is a horizontal sectional view showing the shot-blasting apparatus according to this embodiment. The shot-blasting apparatus according to this embodiment is a type configured to project shots onto a workpiece disposed in a projection chamber, to thereby process the workpiece.

The shot-blasting apparatus comprises a cabinet 10, and a rotary hanger 11 disposed within the cabinet 10. The rotary hanger 11 is a drum-shaped (cylindrical-shaped) rotary hanger disposed such that a longitudinal axis thereof is oriented in a vertical direction. The rotary hanger 11 is configured to be rotated about the longitudinal axis by a rotational drive mechanism.

The rotary hanger 11 comprises a top plate and a bottom plate attached, respectively, at an upper end and a lower end thereof. The rotary hanger 11 has a columnar internal space, which is circumferentially divided into four sub-spaces by three partition plates 12*a*, 12*b*, 16 each extending in a radial direction and in the vertical (axial) direction.

More specifically, the columnar internal space of the rotary hanger 11 is divided into: first and second process chambers 13*a*, 13*b* opposed to each other in the radial direction and each having an approximately trapezoidal-shaped cross section; and first and second external air introduction chambers 17, 18 each formed at a position circumferentially interposed between the first and second process chambers 13*a*, 13*b* and adjacent to the respective first and second process chambers 13*a*, 13*b*, and having a sector-shaped cross-section. Each of the first and second process chambers 13*a*, 13*b* and the first and second external air introduction chambers 17, 18 extends in the vertical direction over the overall height dimension of the rotary hanger 11.

Each of the first and second process chambers 13*a*, 13*b* has the same cross-sectional shape, and each of the first and second external air introduction chambers 17, 18 also has the same cross-sectional shape. Thus, the first and second process chambers 13*a*, 13*b* are arranged at intervals of a given angle, specifically, at positions opposed in the radial direction.

Each of the first and second process chambers 13*a*, 13*b* has a shape in which a surface thereof on a radially outward side of the rotary hanger 11 has no wall, i.e., a shape opened radially outwardly. On the other hand, in each of the first and second external air introduction chambers 17, 18, a surface thereof on the radially outward side of the rotary hanger 11 is closed. Thus, each of the first and second external air introduction chambers 17, 18 is formed as a closed space, except an aftermentioned suction port 19, an aftermentioned air inlet port 22 and the like.

As mentioned above, the rotary hanger 11 is configured to be rotated about the longitudinal axis by the rotational drive mechanism. Thus, according to rotation of the rotary hanger 11, each of the first and second process chambers 13*a*, 13*b* can be selectively set at a position (carry-in-and-out position) on the side of a front end of the apparatus (a lower side in FIG. 4), i.e., at a position where the first process chamber 13*a* is located in FIG. 4, and at a position (projection position) on the side of a back end of the apparatus (an upper side in FIG. 4), i.e., at a position where the second process chamber 13*b* is located in FIG. 4.

In the shot-blasting apparatus according to this embodiment, the cabinet 10 is formed with a carry-in-and-out port 14 communicated with the process chamber 13*a*, 13*b* set at the position on the front-end side of the cabinet 10, to allow an operation for carrying a workpiece in and out of the process chamber 13*a* (13*b*) set at the carry-in-and-out position to be performed through the carry-in-and-out port 14.

The rotary hanger 11 also has a hanger hook (not shown) attached to the top plate thereof to suspendingly support a jig couplable to a workpiece. The hanger hook is disposed in the first and second process chambers 13*a*, 13*b* to allow a workpiece to be suspended within each of the first and second process chambers 13*a*, 13*b*. This hanger hook is configured to be rotatable about its own vertical axis, as with the aforementioned conventional hanger hook. Based on the above structure, a workpiece can be attached to the jig suspended from the hanger hook in the process chamber 13*a*, through the carry-in-and-out port 14 on the front-end side of the cabinet 10.

As shown in FIG. 3, a projection unit 23 is disposed behind the cabinet 10. In the shot-blasting apparatus according to this embodiment, the projection unit 23 is composed of two heretofore-known centrifugal projection units arranged one-above-the-other. The projection unit 23 is operable to project shots onto a workpiece disposed in the process chamber 13*b* (or 13*a*) set at the projection position, to perform shot-blasting.

The shot-blasting apparatus according to this embodiment further comprises a bucket elevator 25 forming a part of a circulation unit for shots. The circulation unit is designed to collect and circulatingly reuse shots projected from the projection unit 23.

Figure 6:
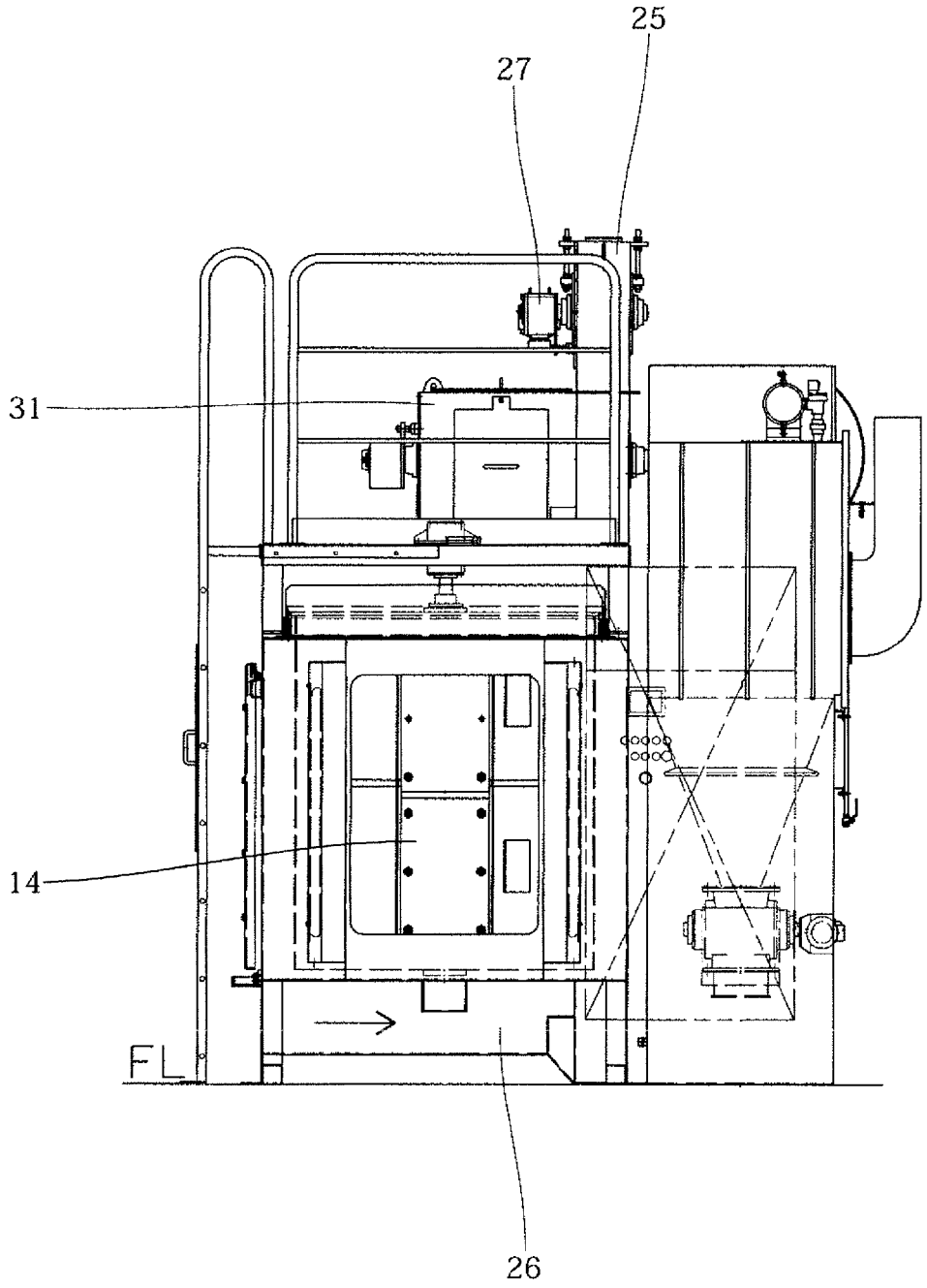
FIG. 6 is a front view of the shot-blasting apparatus in FIG. 3.
Figure 7:
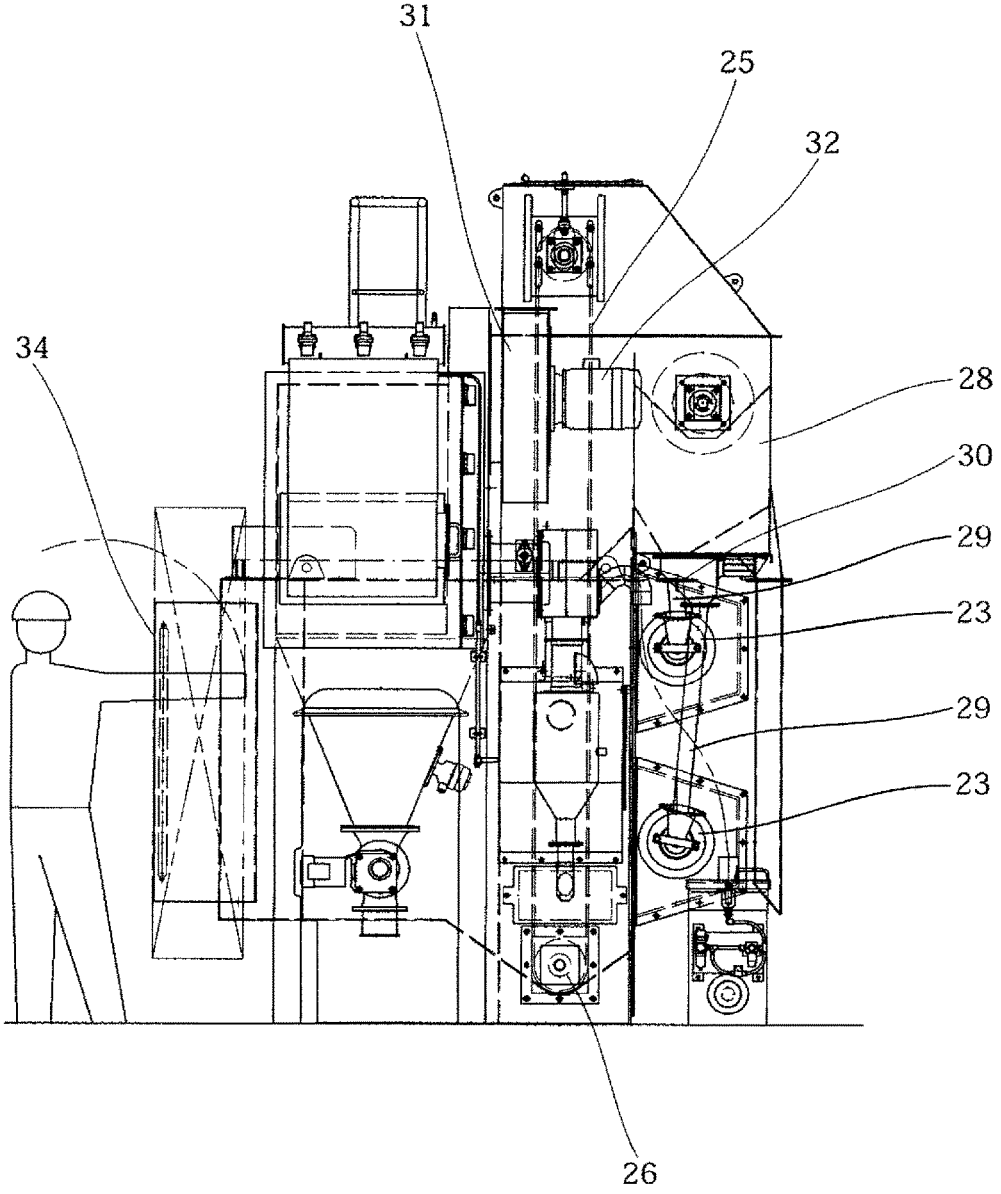
FIG. 7 is a right side view of the shot-blasting apparatus in FIG. 3.
Figure 8:
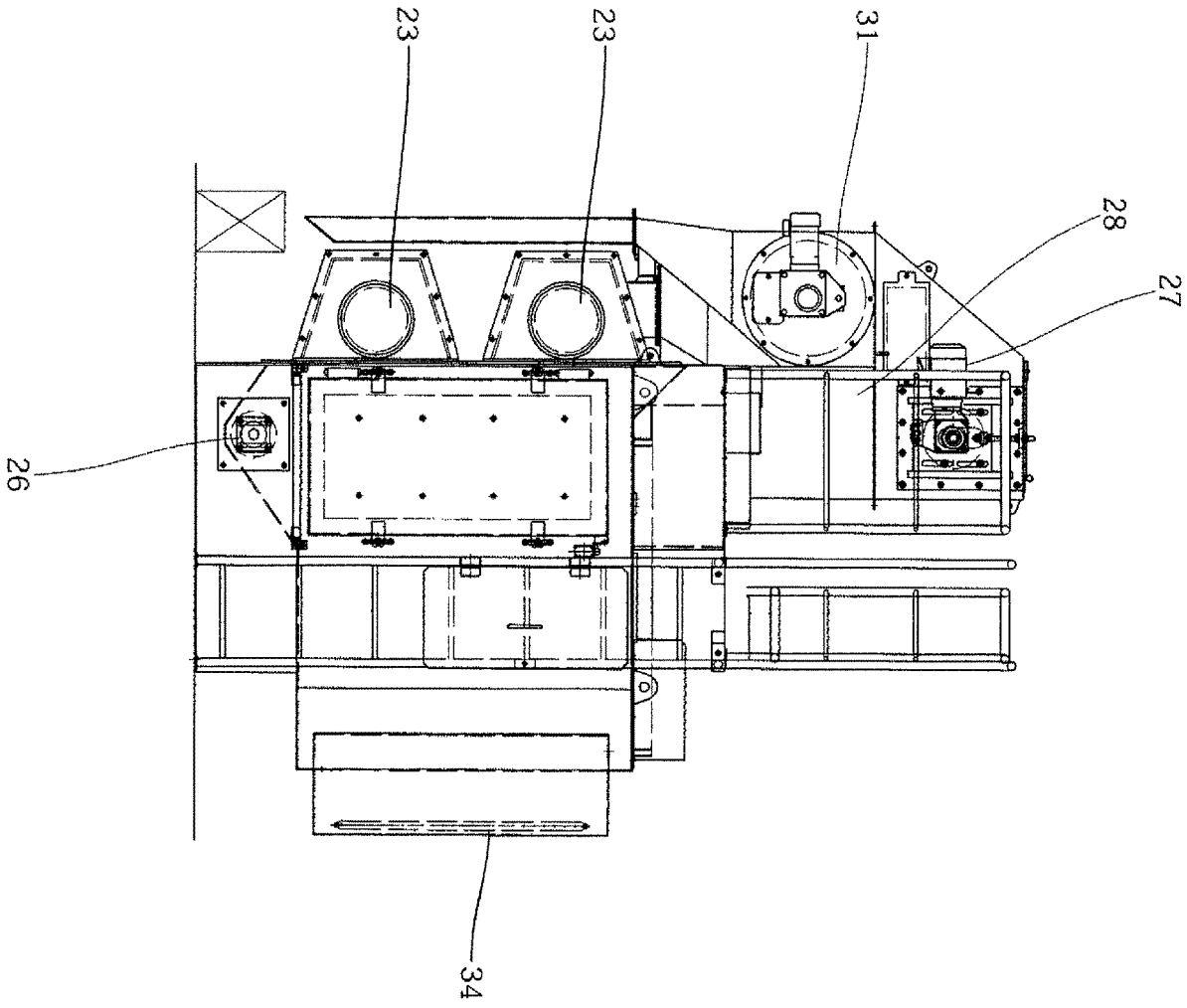
FIG. 8 is a left side view of the shot-blasting apparatus in FIG. 3.

As shown in FIGS. 6 to 8, the circulation unit of the shot-blasting apparatus according to this embodiment comprises a screw conveyer 26 disposed beneath the process chamber 13*b* located at the projection position. The screw conveyer 26 is operable to convey shots falling downwardly from the process chamber 13*b* set at the projection position, rightwardly in FIG. 6, according to rotation of a built-in screw about its axis. The screw conveyer 26 is configured such that a downstream end thereof is connected to a lower portion of the bucket elevator 25 to feed the conveyed shots into the bucket elevator.

The bucket elevator 25 comprises a quadrangular prism-shaped casing, and an endless rubber belt configured to be driven by a motor 27 disposed within the casing. A large number of buckets are attached to the endless rubber belt. In the bucket elevator 25, the buckets are operable to sequentially scoop up the used shots conveyed by the screw conveyer 26, and conveyed the scooped shots to a top of the apparatus, i.e., a top of the cabinet 10, as with a heretofore-known bucket elevator. The shots conveyed to the top by the bucket elevator 25 are stored in a shot tank via a chute, whereafter the shots are sent to a shot introduction pipe 29 via an openable-closable gate 30, and re-projected from the projection unit 23.

The shot-blasting apparatus further comprises a dust collector 31, and a heretofore-known foreign-substance separation unit having a separator, each provided in an upper-end region thereof. The separator is configured to separate and collect foreign substances mixed with shots, such as fine powder, by using a blower 32.

In the shot-blasting apparatus according to this embodiment, the bucket elevator 25 has a suction port (air outlet port) provided at a lower end thereof, and a suction passage for the blower 32 provided thereinside, wherein the blower 32 is operable, upon being activated, to suck air around the lower end of the bucket elevator 25 and send the sucked air to the dust collector 31 so as to collect powder dust generated in the projection chamber and others due to projection of shots.

As mentioned above, each of the first and second external air introduction chambers 17, 18 having a cross-sectionally sector shape is formed at a position circumferentially interposed between the first and second process chambers 13*a*, 13*b*. The first external air introduction chamber 17 is divided into primary and secondary small chambers 17*a*, 17*b* by a division plate 35, and the second external air introduction chamber 18 is divided into primary and secondary small chambers 18*a*, 18*b* by a division plate 36, wherein each of the division plates 35, 36 is disposed to extend in the radial direction and in the vertical direction.

Each of the division plates 35, 36 has a lower portion formed with a vent hole 20 to establish each fluid communication between the first small chambers 17*a*, 17*b* and between the second small chambers 18*a*, 18*b*, through the vent hole 20 in a corresponding one of the division plates 35, 36.

Each of two portions of the top plate of the rotary hanger 11 covering the respective primary small chambers 17*a*, 18*a* is formed with a suction port (external air introduction port) 19 communicated with external air. Thus, each of the primary small chambers 17*a*, 18*a* is communicated with a space outside the apparatus via a corresponding one of the suction ports 19.

Each part of the partition plates 12*b*, 12*a* located between adjacent ones of the secondary small chambers 17*b*, 18*b* whose top plate has no suction port, and the process chambers 13*b*, 13*a*, is formed with two air inlet ports 22 arranged one-above-the-other and each having a vertical directionally elongate rectangular shape and providing fluid communication between adjacent ones of the secondary small chambers 17*b*, 18*b* and the process chambers 13*b*, 13*a*.

Each of the first and second process chambers 13*a*, 13*b* can be communicated with a corresponding one of the secondary small chambers 18*b*, 17*b* via the air inlet ports 22 in a corresponding one of the partition plates 12*a*, 12*b*. That is, external air flowing into the primary small chamber 17*a* (18*a*) via the suction port 19 formed in the portion of the top plate corresponding to the primary small chamber 17*a* (18*a*) flows into the secondary small chamber 17*b*, 18*b* via the vent hole 20 of the division plate 35 (36), and further flows into the process chamber 13*b* (13*a*) via the air inlet ports 22 of the partition plate 12*b* (12*a*).

Each of the air inlet ports 22 is covered by a hood 21 from the side of the secondary small chamber 17*b* (18*b*). The hood 21 comprises a right triangular-shaped side plates arranged side-by-side in parallel relation to each other, and a rectangular-shaped bottom plate connecting the two side plates together. The rectangular-shaped bottom plate has a width approximately equal to a width of the air inlet port 22, and a length greater than a vertical directional length of the air inlet port 22.

Further, one of adjacent sides of the right triangle-shaped side plate extending in the vertical direction has a length approximately equal to the vertical directional length of the air inlet port 22.

The hood 21 is formed in a cross-sectionally angular C shape by joining opposite lateral edges of the bottom plate to respective oblique sides of the two side plates arranged in parallel.

No component is disposed in a space between shorter adjacent sides of the two side plates. Thus, an opening opened upwardly is formed between the shorter adjacent sides of the two side plates. The secondary small chamber 17*b* (18*b*) is communicated with the process chamber 13*b* (13*a*) through the opening 22*a*.

Figure 5:
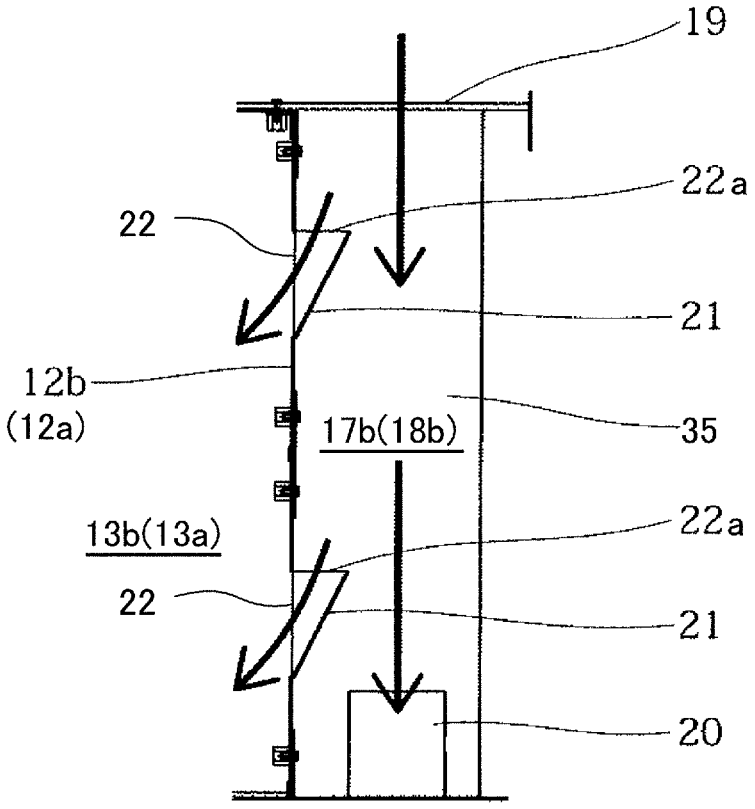
FIG. 5 is a sectional view taken along the line B-B in FIG. 4.

On the other hand, as shown in FIG. 5, the bottom plate of the hood 21 is disposed on the side of the secondary small chamber 17*b* (18*b*) with respect to the air inlet port 22, in such a manner as to extend upwardly from a lower edge thereof connected to a lower edge of the air inlet port 22, while being gradually spaced away from the partition plate 12*b* (12*a*). Therefore, the bottom plate of the hood 21 is disposed in such a manner as to be horizontally spaced apart from the air inlet port 22 toward the secondary small chamber 17*b* (18*b*).

This hood 21 inhibits shots flying from the processing chamber 13*b* (13*a*) toward the secondary small chamber 17*b* (18*b*) via the air inlet port 22 from intruding in the secondary small chamber 17*b* (18*b*).

In addition, the secondary small chamber 17*b* (18*b*) and the primary small chamber 17*a* (18*a*) are partitioned therebetween by the division plate 35 (36), so that the division plate 35 (36) further inhibits a part of shots intruding in the secondary small chamber 17*b* (18*b*) through the opening 22*a* of the hood 21 from intruding in the primary small chamber 17*a* (18*b*).

The shot-blasting apparatus according to this embodiment is configured such that, when one 13*b* (13*a*) of the first and second process chambers is set at the projection position, the air inlet ports 22 for introducing external air into the process chamber 13*b* (13*a*) are disposed at positions opposed to the air outlet port formed in the lower end of the bucket elevator 25, across a central region of the process chamber 13*b* (13*a*).

The hood 21 has the opening opened upwardly, so that, although the air inlet port 22 is covered by the hood 21 in a lateral or circumferential direction, the process chamber 13*b* (13*a*) and the secondary small chamber 17*b* (18*b*) are communicated with each other through the opening.

The number of the air inlet ports 22 is not limited to two. For example, it may be four.

Further, the shape of the side plate of the hood 21 is not limited to a right triangular shape, but may be any other suitable shape such as another triangular shape or a rectangular shape.

Next, an operation of the shot-blasting apparatus constructed as above will be described.

First of all, shots are input from a shot input port (not shown), and then motors for the dust collector 31, the screw conveyer 26, the bucket elevator 25, the projection unit 23 and others are activated according to a manual operation of an operator control panel 34, to circulate the shots around the entire apparatus. For example, the shot is a SUS 304 based shot.

Subsequently, an operator carries a workpiece in the process chamber 13*a* (13*b*) set at the carry-in-and-out position, through the carry-in-and-out port 14 on the front-end side of the cabinet 10. Specifically, the workpiece is attached to the jig suspended from the hanger hook. In the example, the workpiece is an aluminum die-cast component.

Subsequently, the rotary hanger 11 is rotated 180 degrees to move the process chamber 13*a* (13*b*) having the workpiece disposed therein, from the carry-in-and-out position to the projection position on the back-end side of the apparatus. Then, the hanger hook is rotated about its own axis at a rotation speed of 10 to 15 rpm. Further, the openable-closable gate 30 is opened to feed shots stored in the shot tank 28 via the shot introduction pipe 29, so that the shots will be projected onto the workpiece.

Figure 4:
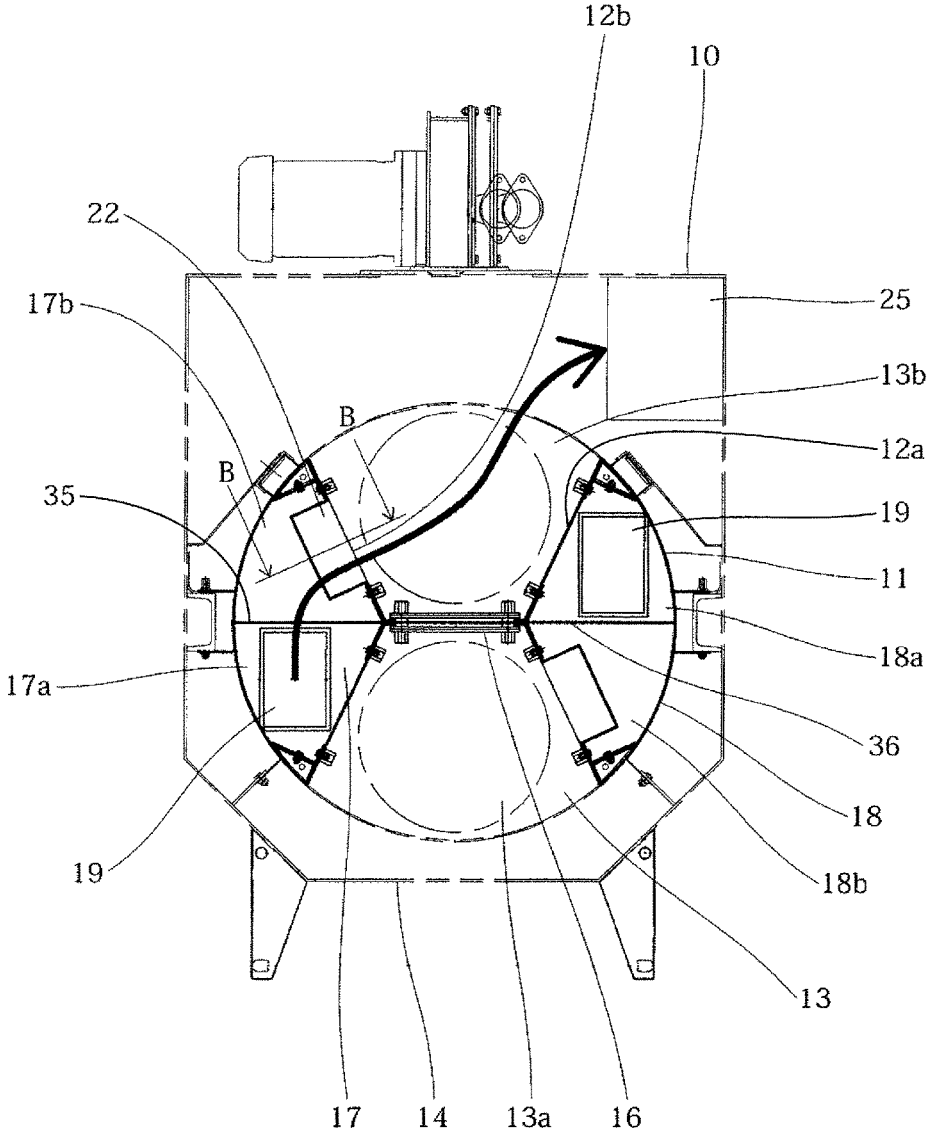
FIG. 4 is a horizontal sectional view of a main part of the shot-blasting apparatus in FIG. 3.

When the process chamber 13*b* is set at the projection position as shown in FIG. 4, ambient air is sucked from the suction port (air outlet port) at the lower end of the bucket elevator 25, by a suction force of the blower 32. Thus, external air is sucked from the suction port 19 formed in a portion of the top plate corresponding to the small chamber 17*a* of the first external air introduction chamber 17, into the small chamber 17*a*. Then, as shown in FIG. 5, the external air sucked in the small chamber 17*a* flows into the adjacent small chamber 17*b* through the vent hole 20 formed in the lower portion of the division plate 35, and flows into the second process chamber 13*b* obliquely downwardly through the air inlet ports 22 for air circulation.

On the other hand, the second external air introduction chamber 18 is isolated from the suction force of the blower by a part of the partition plate 12*a* having no opening, so that no external air is sucked from the suction port 19.

As shown in FIG. 4, the external air flowing into the process chamber 13*b* obliquely downwardly through the air inlet ports 22 flows through the central region of the process chamber 13*b* where duct is most likely to be generated. Subsequently, the external air is sucked into the opening formed at the lower end of the bucket elevator 25 on the back-end side of the cabinet 10, and sucked into the dust collector 31 via the bucket elevator 25. As above, a flow path existing inside the bucket elevator 25 is located at a diagonal position of the cabinet 10 with respect to the suction port 19, and utilized as a suction flow path leading to the dust collector. Air from which powder dust is removed by the dust collector 31 is released into the atmosphere.

In this way, each of the air inlet ports 22 and an inlet of the suction flow path leading to the dust collector are disposed at positions opposed to each other across the central region of the process chamber 13*b* set at the projection position, so that it becomes possible to allow an air flow path along which external air supplied from the air inlet ports 22 flows to pass through a center of the process chamber 13*b* set at the projection position, thereby obtaining far excellent ventilation efficiency as compared to conventional techniques.

As mentioned above, the shot-blasting apparatus according to this embodiment is configured such that a flow path of air sucked from the suction port 19 formed in a top portion of the rotary hanger 11 passes through the central region of the process chamber 13*b* set at the projection position, so that it becomes possible to enhance the ventilation efficiency of the inside of the process chamber to perform efficient dust collection.

In addition, the number of external air suction ports per projection chamber is substantially one, so that it becomes possible to efficiently perform ventilation, using a relatively low-power type as the blower 32, thereby facilitating downsizing of the apparatus.

Furthermore, the inside of the bucket elevator 25 is utilized as a suction flow path, so that it becomes possible to reduce the number of ducts, thereby facilitating downsizing of the entire apparatus.

It should be understood that the present invention is not limited to the above embodiment, but various changes and modifications may be made therein within the technical scope thereof as set forth in appended claims.

What is claimed is:

1. A shot-blasting apparatus comprising:

a cabinet;

a rotary hanger placed in the cabinet for rotation around a central axis;

a plurality of process chambers defined inside the rotary hanger at equal angular intervals in a circumferential direction around the central axis, each of the plurality of process chambers is configured to store a workpiece therein and movable, as the rotary hanger rotates around the central axis, between a first position at which the workpiece is loaded in the process chamber and a second position at which the workpiece is shot-blasted;

an air introduction chamber defined inside the rotary hanger between two adjacent process chambers for rotation with the process chambers, a process chamber and an air introduction chamber adjacent thereto being separated by a partition wall, wherein each air introduction chamber is associated with one process chamber adjacent thereto for introduction of air from an air introduction chamber into its associated process chamber;

a suction port formed in each air introduction chamber and configured to suck external air into the corresponding air introducing chamber therethrough;

an air outlet port fixedly provided in the cabinet for communication with a process chamber placed at the second position; and an air inlet port formed in a partition wall separating a respective process chamber from its associated air introduction chamber and adapted for air communication therebetween to introduce air in an air introduction chamber into its associated process chamber, wherein the air inlet port is positioned in the partition wall to have a geographical relationship with the air outlet port that creates an airflow path running from the air inlet port to the air outlet port across the process chamber located at the second position.

2. The shot-blasting apparatus according to claim 1, wherein the rotary hanger comprises a ceiling, the cabinet comprises a floor, the air outlet port is formed in the floor of the cabinet, the suction port is formed in the ceiling of the rotary hanger, and the inlet port is positioned in a direction of the central axis between the floor of the cabinet and the sealing of the rotary hanger.

3. The shot-blasting apparatus according to claim 2, further comprising a hood attached to a respective inlet port, the hood being formed with an opening facing upward and configured to collect air coming down from the suction port and pass the collected air through the inlet port to the process chamber in a downward direction.

* * * * *